US005351826A

United States Patent [19]

Chen

[11] Patent Number: 5,351,826

[45] Date of Patent: Oct. 4, 1994

[54] FILE BOX

[76] Inventor: Mao-Hsiung Chen, No. 19, Lane 40, Hu Lu St.,, Shih-Lin, Taipei, Taiwan

[21] Appl. No.: 178,780

[22] Filed: Jan. 7, 1994

[51] Int. Cl.[5] ..... B65D 6/10; B65D 6/22; B65D 6/26

[52] U.S. Cl. ..... 206/425; 220/7; 229/198.1

[58] Field of Search ..... 206/425, 215, 218, 449; 220/62, 6, 7, 62.1, 346, 345; 229/198.1

[56] References Cited

U.S. PATENT DOCUMENTS

| | | | |
|---|---|---|---|
| 142,213 | 8/1873 | Derham | 206/425 |
| 265,467 | 10/1882 | Tincher | 206/425 |
| 354,694 | 12/1886 | Diemer et al. | 206/425 |
| 376,140 | 1/1888 | Chamberlain | 206/425 |
| 3,391,848 | 7/1968 | Schmidt | 229/198.1 |
| 4,235,346 | 11/1980 | Liggett | 220/7 |
| 4,763,831 | 8/1988 | Huang et al. | 229/198.1 X |

*Primary Examiner*—Jacob K. Ackun, Jr.
*Attorney, Agent, or Firm*—Poms, Smith, Lande & Rose

[57] ABSTRACT

A file box includes a main board and a bottom board. The main board includes four spaced vertical notches in one face thereof such that the main board is foldable to form four sides of the file box. The face of the main board further has a fifth notch formed in a lower section thereof and extending along a length thereof for securely holding the bottom board when the main board is folded along two inner notches of the four notches. A pair of adhesive tapes are provided to securely hold two sides of the main board together to form a complete file box.

2 Claims, 3 Drawing Sheets

FILE BOX

BACKGROUND OF THE INVENTION

1. Field of the Invention

The present invention relates to a file box, and more particularly to a paper file box which is formed by a foldable main board and a bottom board.

2. Description of Related Art

Paper file boxes are generally constructed by gluing four side boards and a bottom board together. Although the paper file boxes may avoid environmental problems, the structure strength thereof is insufficiently strong in the gluing areas. A further drawback of the conventional file boxes is that they are not foldable after gluing and thus occupy a considerable space. The present invention provides an improved design to mitigate and/or obviate the above-mentioned drawbacks.

SUMMARY OF THE INVENTION

A file box provided by the present invention includes a main board having first and second faces and two sides and a bottom board. The main board is integral and includes a mediate section, first and second side sections respectively extending outwardly from the two sides of the mediate section, and first and second engaging sections respectively extending outwardly from distal sides of the first and second side sections.

The first face of the main board having first, second, third, and fourth vertical notches respectively formed in a transition section between the mediate section and the first side section, in a transition section between the mediate section and the second side section, in a transition section between the first side section and the first engaging section, and in a transition section between the second side section and the second engaging section, allowing the main board to be folded to form four sides of a file box, The first face of the main board further has a fifth notch formed in a lower section thereof and extending along a length thereof for securely holding the bottom board when the main board is folded along the first and second notches.

The second engaging section has a distal end with two opposite faces each to which an adhesive tape is securely attached. The adhesive tapes extend beyond the second engaging section and define a compartment therebetween for receiving the first engaging section. The extension part of each adhesive tape has a sheet peelably mounted to one face thereof which faces the first engaging section when the main board is folded along the third and fourth notches.

Preferably, one of the adhesive tapes has a second extension extending from each of upper and lower ends thereof for covering the upper and lower sides of the first and second engaging sections. Each of the second extensions has a second sheet peelably mounted to one face thereof which faces one of associated upper and lower sides of the first and second engaging sections.

Accordingly, the present invention provides a file box structure which is in a spread flat status for convenient transportation and storage purpose when not in use, and can be easily constructed when in use. The bottom board is securely held by the fifth notch in the lower section of the main board and thus provides a reliable supporting effect.

Other objects, advantages, and novel features of the invention will become more apparent from the following detailed description when taken in conjunction with the accompanying drawings.

DESCRIPTION OF THE PREFERRED EMBODIMENT

Figure 1:
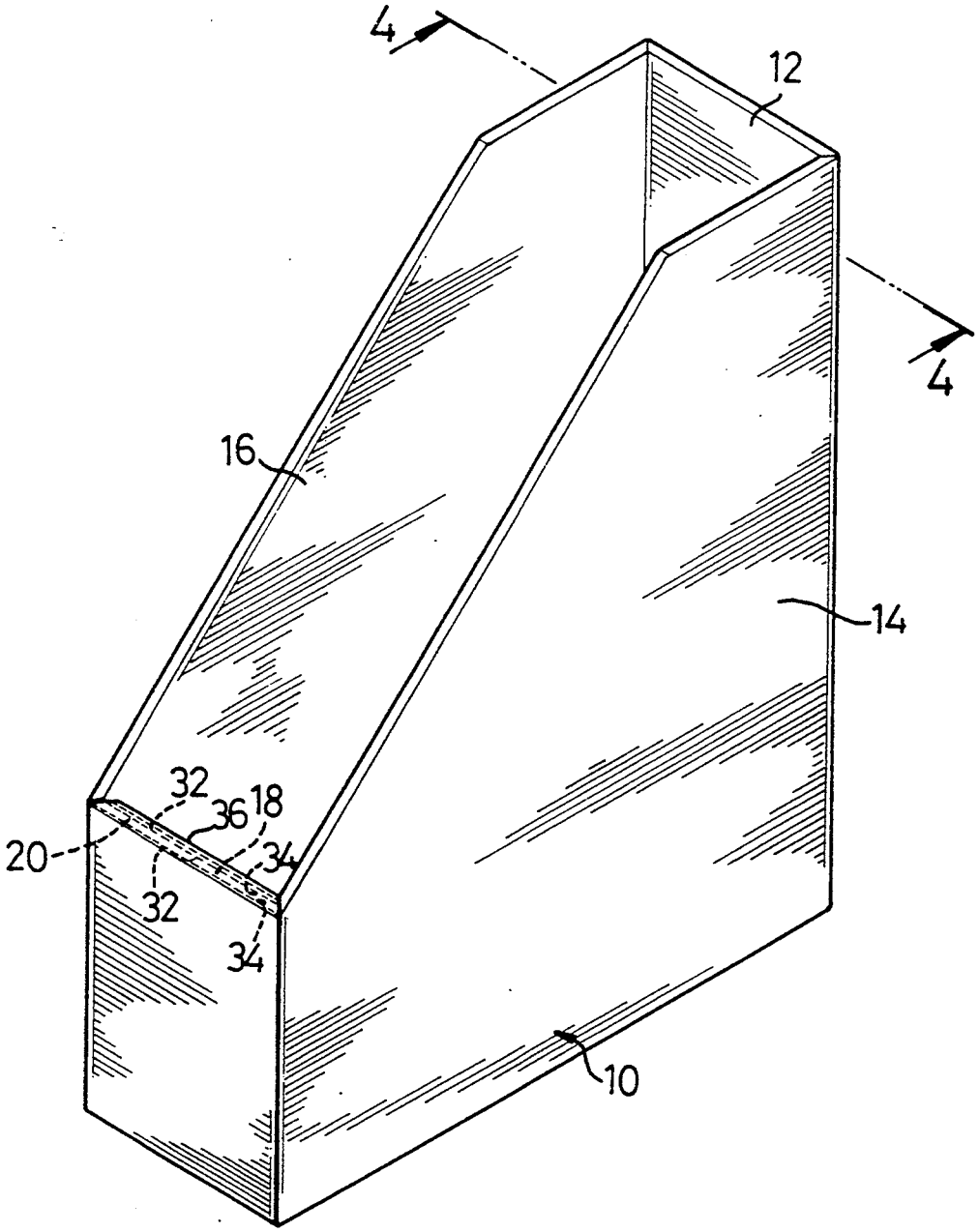
FIG. 1 is a perspective view of a paper file box in accordance with the present invention.

Referring to FIGS. 1 through 4 of the drawings, a file box in accordance with the present invention generally includes a main board 10 having two opposite faces and a bottom board 30. The main board 10 is integral and includes a mediate section 12, first and second side sections 14 and 16 respectively extending outwardly from two sides of the mediate section 12, and first and second engaging sections 18 and 20 respectively extending outwardly from the distal sides of the first and second side sections 14 and 16.

Figure 2:
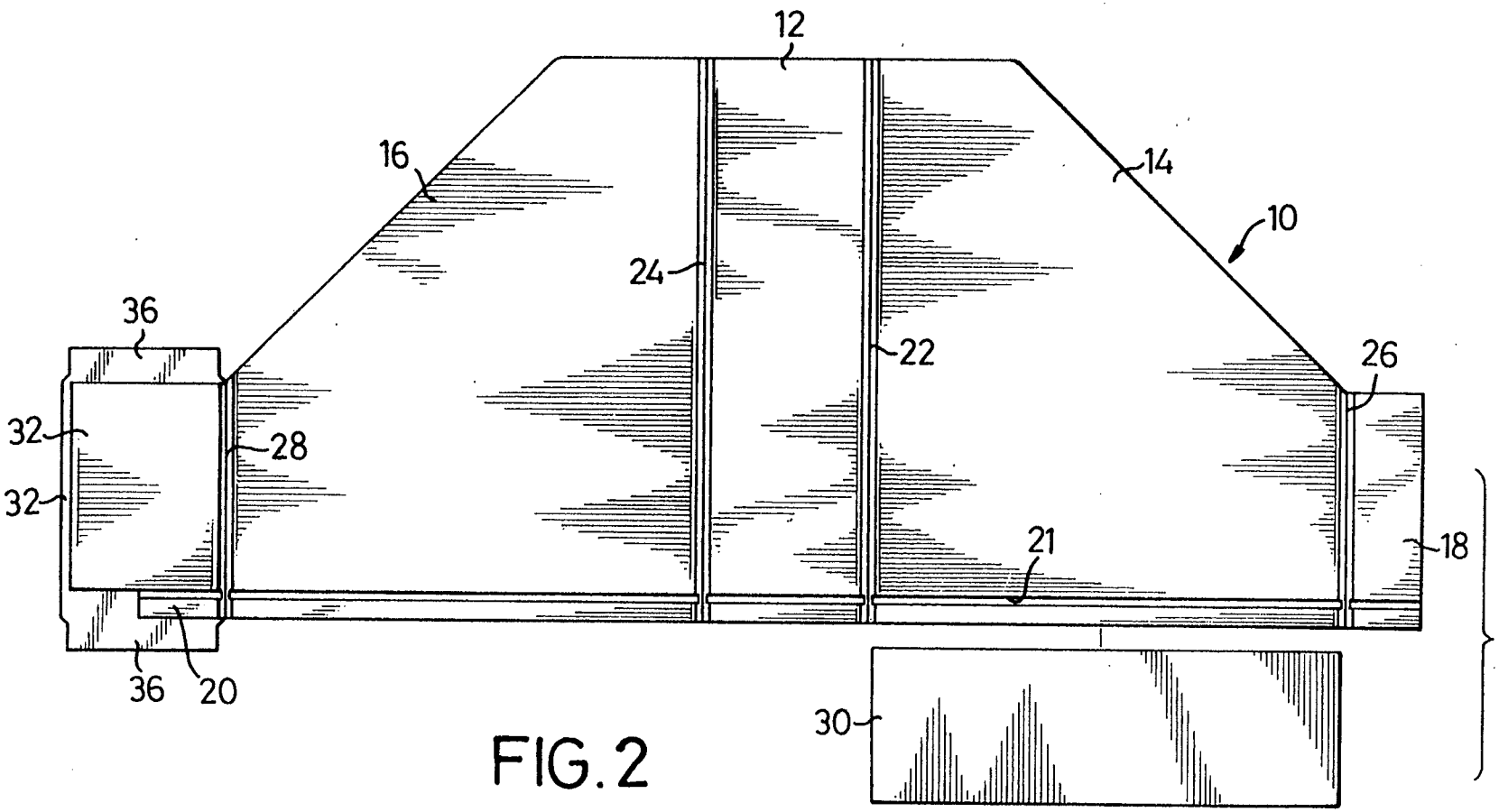
FIG. 2 is an exploded side-elevational view of the paper file box illustrating the bottom board and the main board thereof in a spread status.
Figure 3:
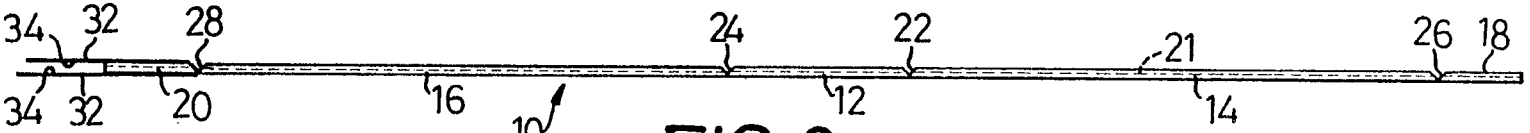
FIG. 3 is a bottom plan view of the main board of the paper file box.
Figure 4:
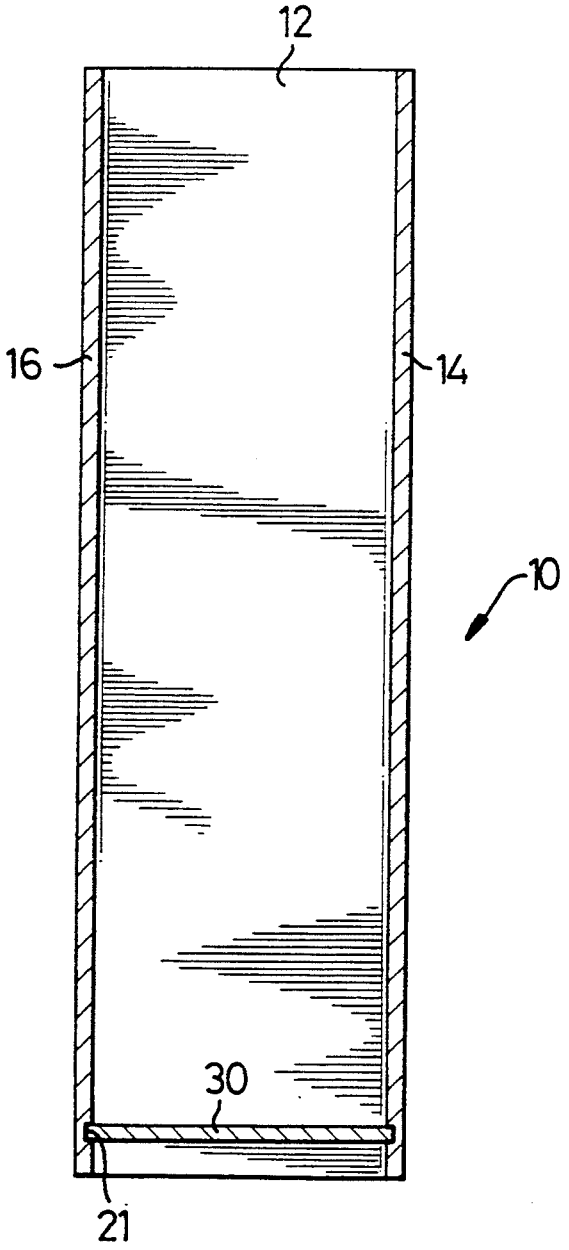
FIG. 4 is a cross-sectional view taken along line 4—4 in FIG. 1.

As can be seen in FIG. 2, in one face of the main board 10, a notch 22 is formed in a transition section between the mediate section 12 and the first side section 14 and extends in a vertical direction. Similar notches 24, 26, and 28 are formed in a transition section between the mediate section 12 and the second side section 16, in a transition section between the first side section 14 and the first engaging section 18, and in a transition section between the second side section 16 and the second engaging section 20. The notches 22, 24, 26, and 28 allow the main board 10 to be folded to form the four sides of a file box which will be further described later.

A further notch 21 is formed in a lower section of the above-mentioned face of the main board 10 and extends from the first engaging section 18 across the first side section 14, the mediate section 12, the second side section 16, and the second engaging section 20 for securely holding the bottom board 30 when the main board 10 is folded.

The second engaging section 20 has a distal end with two opposite faces. An adhesive tape 32 is securely attached to each face of the distal end of the second engaging section 20 at one end section thereof and is covered by a peelable sheet 34 at the other end section thereof which extends beyond the second engaging section 20, the peelable sheets 34 facing associated faces of the first engaging section 18 when the main board 10 is folded along notches 26 and 28. The other end sections of the adhesive tapes 32 define a compartment therebetween for receiving the first engaging section 18.

When in use, the main board 10 is firstly folded along the notches 22 and 24 to form a u-shape construction in which the first and second engaging sections 18 and 20 remain unfolded and thus provides a passage through which the bottom board 30 is inserted into the notch 21 in the lower section in the above-mentioned face of the main board 10. Then, the first and second engaging sections 18 and 20 are turned to align with each other by folding along notches 26 and 28 and the first engaging Section 18 is thereafter inserted into the compartment defined by the other end sections of the adhesive tapes 32. Finally, the adhesive tapes 32 respectively coincide with both sides of the first engaging section 18 after the peelable sheets 34 are peeled away, thereby completing the formation of the file box. Preferably, as shown in FIG. 2, one of the adhesive tapes 32 has an extension 36 extending from each of upper and lower ends thereof for covering the upper and lower sides of the first and second engaging sections 18 and 20, each extension 36 may also be provided with a peelable sheet (not shown) which can be peeled away when in use. Preferably, a colorful sheet (not shown) may be provided to cover each of two faces of the main board 10 for decoration and identification purposes.

Accordingly, the present invention provides a file box structure which is in a spread flat status for convenient transportation and storage purpose when not in use, and can be easily constructed by the above-described procedure. The bottom board 30 is securely held by the notch 21 and thus provides a reliable supporting effect.

Although the invention has been explained in relation to its preferred embodiment, it is to be understood that many other possible modifications and variations can be made without departing from the spirit and scope of the invention as hereinafter claimed.

I claim:

1. A file box comprising:

a main board having first and second faces and two sides and a bottom board, said main board being integral and comprising a mediate section, first and second side sections respectively extending outwardly from two sides of said mediate section, and first and second engaging sections respectively extending outwardly from distal sides of said first and second side sections;

said first face of said main board having first, second, third, and fourth vertical notches respectively formed in a transition section between said mediate section and said first side section, in a transition section between said mediate section and said second side section, in a transition section between said first side section and said first engaging section, and in a transition section between said second side section and said second engaging section, allowing said main board to be folded to form four sides of a file box;

said first face of said main board having a fifth notch formed in a lower section thereof and extending along a length thereof for securely holding said bottom board when said main board is folded along said first and second notches;

said second engaging section having a distal end with two opposite faces, each of said faces of said distal end of said second engaging section having an adhesive tape securely attached thereto, each of said adhesive tapes having an extension which extends beyond said second engaging section, said extensions defining a compartment therebetween for receiving said first engaging section, and said extension of each said adhesive tape having a sheet peelably mounted to one face thereof which faces said first engaging section when said main board is folded along said third and fourth notches.

2. The file box as claimed in claim 1 wherein one of the adhesive tapes has a second extension extending from each of upper and lower ends thereof for covering upper and lower sides of said first and second engaging sections, and each of said second extensions has a second sheet peelably mounted to one face thereof which faces one of associated said upper and lower sides of said first and second engaging sections.

* * * * *